US007260479B2

(12) United States Patent
McElhinney

(10) Patent No.: US 7,260,479 B2
(45) Date of Patent: Aug. 21, 2007

(54) METHOD FOR LOCATING CASING JOINTS USING MEASUREMENT WHILE DRILLING TOOL

(75) Inventor: Graham McElhinney, Inverurie (GB)

(73) Assignee: PathFinder Energy Services, Inc., Houston, TX (US)

( * ) Notice: Subject to any disclaimer, the term of this patent is extended or adjusted under 35 U.S.C. 154(b) by 38 days.

(21) Appl. No.: 11/343,543

(22) Filed: Jan. 31, 2006

(65) Prior Publication Data

US 2006/0173626 A1 Aug. 3, 2006

(30) Foreign Application Priority Data

Jan. 31, 2005 (GB) ..... 0501929.4

(51) Int. Cl.
*G01V 3/18* (2006.01)
*E21B 47/09* (2006.01)
*G01N 27/72* (2006.01)

(52) U.S. Cl. ..... 702/9

(58) Field of Classification Search ..... 702/6, 702/7, 9, 10
See application file for complete search history.

(56) References Cited

U.S. PATENT DOCUMENTS 5,429,190 A 7/1995 Kilgore et al.
5,720,345 A 2/1998 Price et al.
6,192,748 B1 2/2001 Miller
6,411,084 B1 6/2002 Yoo
6,815,946 B2 11/2004 Yoo

FOREIGN PATENT DOCUMENTS

GB 2387657 A 10/2003
GB 2405212 A 2/2005
GB 2405213 A 2/2005
WO WO 02/099250 12/2002

*Primary Examiner*—Donald E McElheny, Jr.

(57) ABSTRACT

A method for locating casing string joints using a measurement while drilling tool is disclosed. The method includes deploying an MWD tool in a wellbore and measuring the magnetic field along a length of the wellbore. Changes in the magnetic field along the length of the wellbore are evaluated to determine the location of at least one casing joint. Embodiments of this invention may be advantageously utilized, for example, in sidetracking operations to avoid milling through a casing joint. Use of this invention may obviate the need for a separate wireline run to locate the casing joints.

26 Claims, 2 Drawing Sheets

METHOD FOR LOCATING CASING JOINTS USING MEASUREMENT WHILE DRILLING TOOL

RELATED APPLICATIONS

This application claims priority to commonly-invented, commonly-assigned, co-pending United Kingdom patent application serial no. 0501929.4, filed Jan. 31, 2005.

FIELD OF THE INVENTION

The present invention relates generally to drilling and surveying subterranean boreholes such as for use in oil and natural gas exploration. In particular, this invention relates to a method for locating one or more casing string joints using a downhole measurement while drilling tool. Moreover, this invention relates to a method for sidetracking a new borehole out of an existing cased wellbore.

BACKGROUND OF THE INVENTION

Subterranean wells are typically cased with a string of steel wellbore tubulars (piping) coupled end-to-end and cemented in place in the wellbore. The casing string is intended to prevent the wellbore from deterioration and also provides a conduit for produced hydrocarbons. It is often necessary to precisely locate one or more of the joints at which adjacent wellbore tubulars are coupled (e.g., a threaded joint where the male end of one tubular is threadably coupled to the female end of an adjacent tubular). This need arises, for example, when it is necessary to sidetrack an existing well.

Numerous downhole tools and methods are known in the art for locating casing joints (such tools are referred to herein—and commonly in the art—as casing collar locators or sometimes more simply as locators). For example, conventional casing collar locators typically rely on the generation of a strong magnetic field using either a permanent magnet or an electromagnet deployed on the locator. As the locator is moved past a collar, the flux density of the magnetic field changes due to the increased thickness of the collar. The change in magnetic flux produces an electric signal that is transmitted to the surface via a conventional wireline.

Such conventional casing collar locators suffer from many known operational disadvantages. For example, conventional locators are not particularly sensitive to changes in the casing string and thus tend to exhibit a low signal to noise ratio. Moreover, as a result of their insensitivity to changes in the casing string, conventional locators are essentially "collar" locators (rather than "joint" locators) and are generally not able to reliably detect other types of casing joints, such as box and pin joints (also referred to in the art as flush joints). Furthermore, and also as a result of their insensitivity to changes in the casing string, conventional locators are generally only reliable when they are moved rapidly through the wellbore. If the locator is moved too slowly, the changes in signal indicative of the presence of a collar may be too gradual to be conclusively recognized.

More recently, other casing collar locators have been developed to address some of the aforementioned drawbacks with conventional casing collar locators. For example, U.S. Pat. No. 5,720,345 to Price et al. and U.S. Pat. Nos. 6,411,084 and 6,815,946 to Yoo disclose downhole tools that detect magnetic fields indicative of the presence of the casing joints. Price et al. discloses a magnetometer based wireline tool. The magnetic field is continuously measured while the tool is moved through the casing string. It is further disclosed that the magnetic field inside the casing changes at a maximum rate at the casing joint as the wireline tool is moved past the joint. Yoo discloses a wireline tool including a giant magnetoresistive sensor intended to detect perturbations in the earth's magnetic field caused by anomalies in the casing string. Such anomalies are disclosed to include gaps between casing tubulars, enlarged casing wall thickness due to external collars, and air gaps in the threads of a casing joint. Yoo also discloses detection of other anomalies not associated with casing joints such as perforations and damage to the casing string.

The aforementioned devices overcome some of the limitations of conventional casing collar locators, in particular, in that they are more sensitive to changes in the casing string. Despite the advances disclosed by Price et al. and Yoo, the use of such casing collar locators is disadvantageous for certain applications. For example, casing collar locators known in the art (including those described above) are wireline tools. As such, their use requires a separate wireline run into the borehole to determine the locations of various casing joints. As described in more detail below, a typical sidetracking operation includes running a wireline casing collar locator into the borehole to determine the location of a particular casing joint and to set a bridge plug. Only after the bridge plug has been set and the wireline tool removed from the borehole can the drill string and accompanying whipstock be lowered into the borehole. Sidetracking operations including wireline runs are known in the art to be both time consuming and expensive.

Therefore there exists a need for an improved method for locating casing joints. In particular, there exists a need for a measurement while drilling based method for locating casing joints that does not require a separate wireline run into the borehole.

SUMMARY OF THE INVENTION

Exemplary aspects of the present invention are intended to address the above described drawbacks of prior art apparatuses and methods for locating wellbore casing joints. One aspect of this invention includes a method utilizing an MWD tool to detect a casing joint in a cased wellbore. In one exemplary embodiment, a drill string including a magnetic field sensor is deployed in a cased borehole. Magnetic field measurements may be acquired, for example, at a plurality of longitudinal positions in the wellbore and transmitted uphole. Changes in the measured magnetic field may then be utilized to determine the location of one or more casing joints. Embodiments of this invention may be utilized to locate one or more casing joints in a sidetracking operation in which a new well is drilled from the side of an existing cased wellbore.

Exemplary embodiments of the present invention may advantageously provide several technical advantages. For example, embodiments of this invention may be utilized to locate substantially any type of casing joint. Moreover, exemplary embodiments of this invention may be utilized to sidetrack a cased wellbore. Use of this invention in sidetracking operations may therefore obviate the need for a separate wireline run to locate the casing joints, thereby potentially saving significant rig time.

In one aspect the present invention includes a method for locating at least one casing joint in a cased wellbore having a substantially permanent magnetization. The method includes deploying a magnetic field measurement device in the cased wellbore, the magnetic field measurement device coupled to a drill string and positioned to be within sensory range of magnetic flux from the substantially permanent magnetization. The method further includes measuring the magnetic flux along a length of the cased wellbore using the magnetic field measurement device and evaluating changes in the magnetic flux measured in (b) along the length of the wellbore to locate the at least one casing joint.

In another aspect, this invention includes a method for sidetracking a cased wellbore having a substantially permanent magnetization. The method includes deploying a drill string in the cased wellbore, the drill string including a magnetic field measurement device and a drill bit assembly deployed thereon. The magnetic field measurement device is positioned to be within sensory range of magnetic flux from the substantially permanent magnetization. The method further includes measuring the magnetic flux along a length of the cased wellbore using the magnetic field measurement device to locate at least one casing joint and milling an opening in the cased wellbore using the drill bit assembly at a position selected to avoid milling through the located casing joint.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
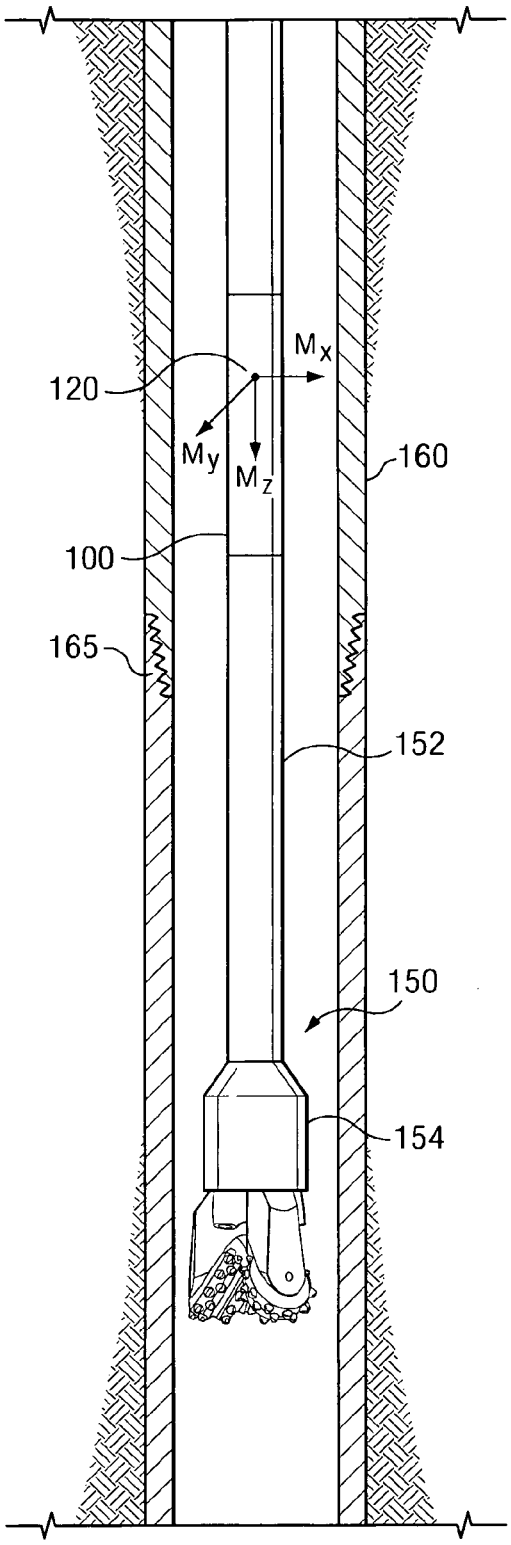
FIG. 1 depicts an MWD tool according to the present invention deployed in a cased wellbore.

Referring to FIG. 1, one exemplary embodiment of a downhole tool 100 useful in conjunction with exemplary methods of the present invention is illustrated. In FIG. 1, downhole tool 100 is illustrated as a measurement while drilling (MWD) tool including a sensor 120 having three mutually orthogonal magnetic field sensors, one of which is oriented substantially parallel with the borehole axis. Downhole tool 100 is shown coupled to a bottom hole assembly (BHA) 150 including, for example, a drilling motor 152 and a drill bit assembly 154. It will be appreciated that this invention is not limited to any particular BHA components. The bottom hole assembly may include substantially any known drill bit assemblies, rotary assemblies, positive displacement assemblies, rotary steerable tools, bent housings, and the like.

In the exemplary embodiment shown, sensor 120 may be considered as determining a plane (defined by $M_X$ and $M_Y$) orthogonal to the borehole axis and a pole ($M_Z$) parallel to the borehole axis, where $M_X$, $M_Y$, and $M_Z$ represent measured magnetic field vectors in the x, y, and z directions. As described in more detail below, exemplary embodiments of this invention may only require magnetic field measurements along a single axis (e.g., along the axis of the borehole). As such, embodiments of this invention are not limited to the use of a tri-axial magnetic field sensor such as that shown on FIG. 1. It will be appreciated, that while not shown, downhole tool 100 may also include other conventional survey sensors such as one or more accelerometers and/or gyroscopes.

In one advantageous embodiment, sensor 120 is configured for conventional MWD magnetic field measurements (e.g., measurements of the relatively weak magnetic field of the earth for use in conventional borehole surveying). In such embodiments, sensor 120 may include, for example, a conventional tri-axial magnetometer. Suitable magnetometer packages are commercially available, for example, from MicroTesla, Ltd., or under the brand name Tensor (™) by Reuter Stokes, Inc. It will be understood that the foregoing commercial sensor packages are identified by way of example only, and that the invention is not limited to any particular deployment of commercially available sensors.

Embodiments of this invention utilize measurements of the remanent magnetization in conventional casing tubulars to determine the location of casing joints. Such remanent magnetization is typically residual in the casing string because of magnetic particle inspection techniques that are commonly utilized to inspect the threaded ends of individual casing tubulars for cracks and other defects. The magnetic particle inspection techniques produce a highly localized, strong magnetic field at the ends of the casing tubulars, and consequently at the casing joints in the borehole. Between casing joints, the remanent magnetic field is typically considerably weaker than at the joints.

It will be appreciated by those of ordinary skill in the art, that the magnetic field of the earth is relatively weak as compared to the remanent magnetic field inside the casing string. For example, it is well known that such remanent magnetic fields interfere with reliable azimuth determination in and around a cased borehole. Thus, in an embodiment suitable for conventional MWD applications, sensor 120 may be calibrated to be sensitive to small magnetic fields (so that it may reliably measure the magnetic field of the earth). For example only, in one embodiment sensor 120 may include a tri-axial magnetometer (as described above) calibrated to have a sensitivity of 0.00002 Gauss along each of its three axes. It will also be appreciated that the magnetic fields in the casing string, and in particular those in close proximity to casing joints, may be significantly greater than the saturation value of sensor 120. For example, the strength of the magnetic field in the casing string may sometimes exceed 10 Gauss, as compared to a saturation threshold for the sensor of less than about 1.0 Gauss in one exemplary embodiment. As described in more detail below, exemplary methods of this invention make use of such sensor saturation along particular axes to assist in determining casing joint location. However, the invention is not limited to any particular ranges of sensor sensitivities or saturation values.

Locating Casing Joints

With continued reference to FIG. 1, downhole tool 100 is shown deployed in a cased borehole 160 proximate to one or more casing joints 165. In the embodiment shown, casing joint 165 is of the box and pin type, however the invention is not limited in this regard. Rather, embodiments of this invention are suitable for detecting and locating casing joints of substantially any type. In a typical embodiment, a drill string including downhole tool 100 and BHA 150 is lowered into the borehole to some predetermined depth (e.g., to about a depth at which a sidetracking operation is to be performed). Magnetic field measurements are then taken and transmitted uphole (e.g., via substantially any conventional telemetry technique). The tool is then moved slowly upwards or downwards (along the axis of the wellbore), for example, in increments of about one foot or less. At each increment, the magnetic field may be measured and transmitted to the surface. The magnetic field measurements are typically displayed and processed at the surface. As described in more detail below, the processing typically includes evaluating changes in the direction and strength of the measured magnetic flux. It will be appreciated that magnetic field measurements may be made at substantially any number of increments, but it is often desirable (although not necessary) to make measurements at enough increments to detect at least two adjacent casing joints. The distance between detected casing joints may then be compared with the casing log (or tally) that lists the dimensions of the casing tubulars used in casing the wellbore. In this manner erroneous data may be advantageously identified and discounted.

As the sensor approaches a casing joint, both the magnitude and direction of the magnetic field inside the casing string typically change. This is shown schematically on FIG. 2. The casing string is shown at 202. The magnetic field is represented as vectors 212. As shown by the increasing length of the magnetic field vectors 212 (and as described above), the magnetic field strength typically increases significantly as a sensor approaches a casing joint 205. Moreover, as also shown on FIG. 2, the direction of the magnetic field typically rotates from being substantially aligned with the casing string (as shown by vector 212A) to substantially orthogonal to the casing string (as shown by vector 212B) as a sensor approaches a casing joint 205.

It will be appreciated that, in practice, changes in the local magnetic field at the casing joints are often more complex than that described above with respect to FIG. 2, since magnetic particle inspection magnetization is not a carefully controlled process. In general, the strength and direction of the magnetic field imposed on the threaded end of the casing tubular during magnetic particle inspection is not important (as long as the process produces a strong enough field to facilitate the inspection process, the field strength is sufficient). The strength and direction of the resulting field may, therefore, vary from one casing tubular to the next and consequently from one casing joint to the next after the tubulars are coupled and deployed in a well. Nevertheless, owing to the local nature of the magnetization at the threaded ends of the casing tubulars, local changes in the magnetic field at the casing joints are typically readily detectable and suitable for detecting and locating the joints.

Figure 3A:
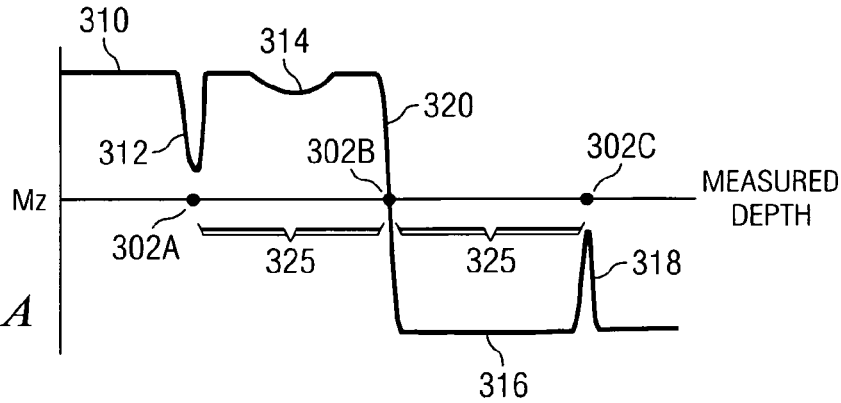
FIG. 3A plots the axial component of the measured magnetic field versus the measured depth of a hypothetical section of a cased wellbore.
Figure 3B:
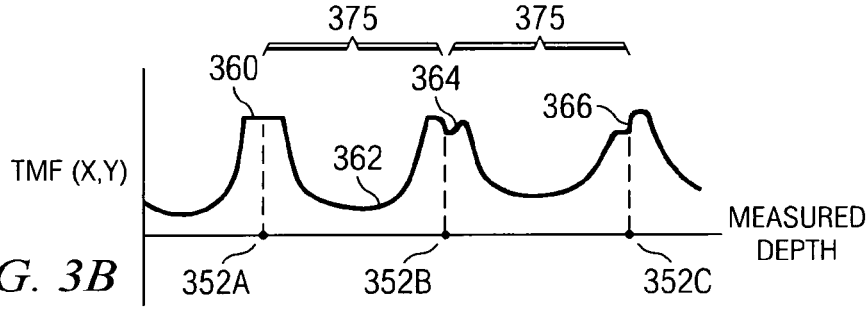
FIG. 3B plots the cross-axial total magnetic force of the measured magnetic field versus the measured depth of a hypothetical section of a cased wellbore.

Referring now to FIGS. 3A and 3B, plots of the magnetic field strength along a hypothetical cased borehole are shown to illustrate exemplary changes in the magnetic field that may be expected at various casing joints. FIG. 3A plots the axial component of the measured magnetic field, $M_Z$, along the length of the hypothetical cased borehole on the vertical axis versus the measured depth of the borehole on the horizontal axis. Hypothetical casing joints are shown on FIG. 3A at 302A, 302B, and 302C. FIG. 3B plots the measured cross-axial total magnetic force, TMF(xy), along the length of another hypothetical cased borehole on the vertical axis versus the measured depth of the borehole on the horizontal axis. Hypothetical casing joints are shown on FIG. 3B at 352A, 352B, and 352C.

Turning now to FIG. 3A, due to the sensitivity of a typical MWD magnetic field sensor (e.g., sensor 120 shown on FIG. 1) and the orientation of the magnetic field approximately along the borehole, $M_Z$ is generally sufficiently strong to saturate the sensor at locations between the casing joints as shown at 310 and 316. At many casing joints, as the sensor approaches the joint (e.g., moves longitudinally within a few feet thereof), $M_Z$ decreases below the saturation value of the sensor (as shown at 312 and 318) to substantially a minimum at a location adjacent to the casing joint (e.g., as shown at joints 302A and 302C). After moving a few feet past the casing joint, the sensor typically becomes saturated again. It will be appreciated that depending on the strength of the magnetization imparted to the particular casing tubulars, $M_Z$ may be sufficiently low at one or more locations between the casing joints so as not to saturate the sensor. This effect is shown, for example, at 314 and may at times be useful in locating a section of casing string between casing joints (e.g., the center of a casing tubular).

Figure 2:
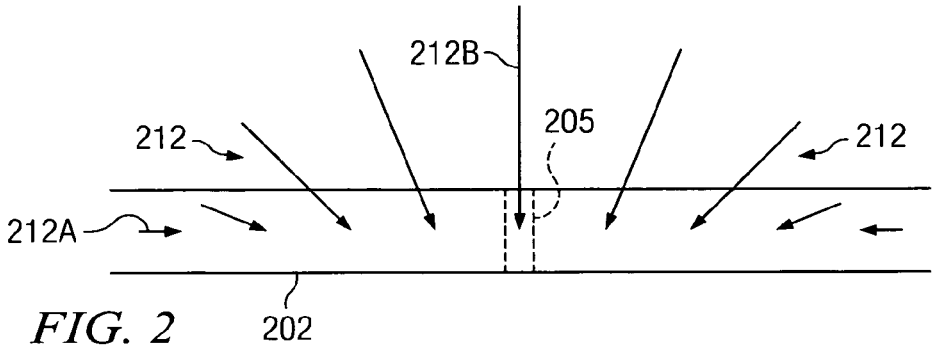
FIG. 2 is a simplified schematic representation of the magnetic field about an exemplary section of a casing string.

It will also be appreciated that while the sensor is saturated at both 310 and 316, even in its saturated state, it nevertheless indicates the relative axial direction of the magnetic field (e.g., positive at 310 and negative at 316). At some casing joints (such as casing joints 205 shown on FIG. 2 and 302B shown on FIG. 3A), $M_Z$ may change from being saturated in one direction to saturated in the other direction, for example, as shown at 320 on FIG. 3A. Depending upon the spacing of the measurement points and the shape and intensity of the local magnetic field, the sensor may remain saturated, with only a sign change in $M_Z$ (e.g., positive to negative as shown at 320) indicating the presence of the casing joint. Alternatively, $M_Z$ may decrease below the saturation threshold of the sensor for one or more measurement locations prior to changing sign and resaturating.

Turning now to FIG. 3B, casing joints (such as joints 352A, 352B, and 352C) may also be located based on the cross-axial components (x and y) of the magnetic field. At many casing joints, both the x and y components of the magnetic field are sufficiently strong to saturate the sensor near a casing joint. In such instances TMF(xy) is at a maximum at locations near the casing joint (e.g., as shown at 360 for casing joint 352A). The location of casing joint 352A may, for example, be approximated as the midpoint of saturation region 360. At locations between the casing joints, the strength of the cross-axial magnetic field components typically decreases well below the saturation value of the sensor as shown at 362.

At many other casing joints, only one of the cross-axial components (x and y) saturates the sensor. This may occur, for example, because the cross-axial component of the magnetic field is closely aligned with either the x or y components of the sensor (e.g., within about 30 degrees thereof). In such instances, there is often a dip 364 or an inflection 366 in TMF(xy) at or near the casing joint that indicates the location of the joint (e.g., joints 352B and 352C). Such dips and/or inflections may be caused, for example, by a local distortion of the magnetic field at the casing joint causing a small change in the direction of the field (e.g., less than about 30 degrees). Nevertheless, dips and/or inflections in TMF(xy) may often be used to more accurately determine the location of the casing joints. Moreover, rotation of the drill string at the surface (which changes the tool face of the sensor) may be utilized to induce such dips and/or inflections in TMF(xy). Thus, in some applications, it may be advantageous to acquire a plurality of magnetic field measurements at a corresponding plurality of sensor tool faces at one or more locations in the borehole. In this manner it may be possible to more accurately determine the location of a particular casing joint.

The hypothetical examples described above with respect to FIGS. 3A and 3B make use of sensor saturation, among other factors, to determine the location of various casing joints. It will be appreciated that the invention is not limited in this regard and does not require such sensor saturation. For example, magnetic field sensors having a greater saturation threshold may be utilized in some applications. Moreover, certain sections of a casing string may have a relatively weak magnetic field (as compared to other sections thereof) and thus not saturate the sensors. In such instances the same techniques as described above with respect to FIGS. 3A and 3B may often be used to determine the location of the casing joints. For example, identification of the minima in the axial component of the magnetic field may be suitable to locate the joints. Moreover, it may be advantageous in such instances to determine the magnetic field vector from the measured x, y, and z components of the magnetic field and to utilize changes in the vector (e.g., changes in the angle of the vector with respect to the z axis or changes in the magnitude of the vector) to locate a casing joint.

In many applications the length of the casing tubulars is known, e.g., from a casing log kept during the casing operation. Comparison of the known length of particular casing tubulars with the measured spacing between joints (e.g., as shown at 325 and 375 on FIGS. 3A and 3B) may be used as a diagnostic. In this manner, noisy or erroneous data may be discounted and the regular spacing of the casing joints identified.

Figure 4:
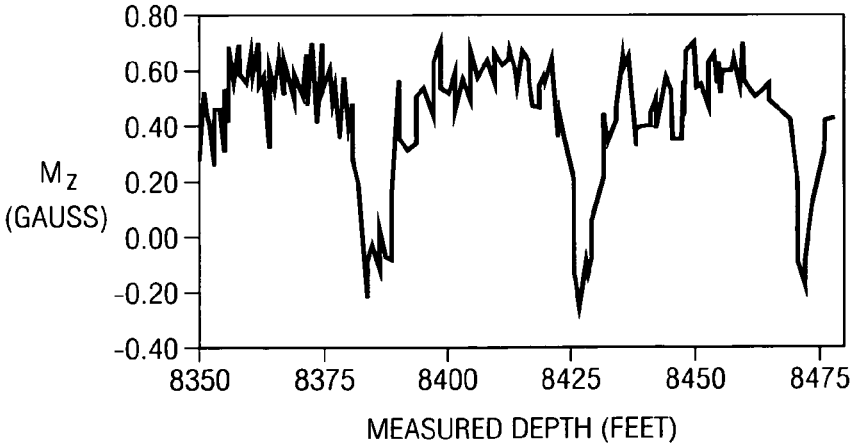
FIG. 4 plots the axial component of the measured magnetic field versus the measured depth of an offshore cased wellbore.

Referring now to FIG. 4, exemplary methods of the present invention are discussed further by way of an actual field test. A drill string including an MWD tool having a tri-axial magnetic field sensor similar to that described above with respect to FIG. 1 was deployed in a high inclination section of an offshore well and utilized to determine the location of three casing joints in the well. The MWD tool was run into the well to a measured depth of about 8350 feet. Examination of a casing log indicated that casing tubulars having a length of 14 meters (about 44 feet) were utilized in this section of the well. Magnetic field measurements were made and transmitted to the surface via conventional mud pulse telemetry at about 6 inch intervals between measured depths of about 8350 and about 8475 feet (for a total of about 250 measurement points).

FIG. 4 plots the measured axial component of the magnetic field verses the measured depth of the borehole. The location of each of the three casing joints is readily apparent from a visual inspection of the plot. As shown, the axial component of the magnetic field decreased significantly at about 44 foot intervals along the well (i.e., at measured depths of 8385, 8428, and 8472 feet). The observed interval is consistent with the known length of the casing tubulars. Moreover, as expected, the magnitude of the axial component of the magnetic field was at or near the saturation value of the sensor (about 0.7 Gauss) between the casing joints.

While the magnetic field data shown on FIG. 4 is not filtered or otherwise processed in any way, it will be appreciated that various known filtering and/or data processing techniques may be advantageous utilized in certain applications. For example, sensor data may be filtered or averaged to minimize noise using substantially any known techniques. Additionally, thresholds may be applied to the data to aid in the identification of casing joints. For example, magnetic field measurements having a value greater than some threshold may be discarded. Moreover, other processing techniques may be utilized to identify the periodicity of casing joint spacing (such as Fourier analysis or other known techniques).

Sidetracking a Cased Well

In recent years, many subterranean drilling operations have begun to reenter and sidetrack existing cased wells, for example, to take advantage of newer drilling and production technologies. In such sidetracking operations, one or more new wells are drilled from the side of an existing cased well. In general, it is undesirable to sidetrack an existing well at a casing joint, since the joint may prevent the bridge plug or whipstock from setting properly in the casing. Furthermore, milling through a joint or collar is often difficult and may result in a jagged opening in the casing string. The jagged opening may cause difficulties in running new casing string and/or various downhole tools into the new well. Moreover, drilling through a casing joint may damage the structural integrity of the casing. Thus, in general, it is desirable to sidetrack wells at "blank" regions of the casing string between adjacent casing joints.

During a typical conventional sidetracking operation, a wireline casing collar locator is used to locate a series of casing joints. This necessitates a separate wireline run into the cased wellbore. Upon locating a predetermined casing joint (or joints), a bridge plug is set (typically a few feet uphole of a casing joint) and the wireline tool is removed from the wellbore. A drill string including a drill bit assembly (also referred to in the art as a milling tool) and a whipstock is then lowered into the wellbore. The whipstock is typically oriented at a predetermined tool face using conventional gyroscope measurements. The whipstock is then set on the bridge plug and an opening is milled through the casing string. As stated above, the necessity of using a separate wireline run into the well is both time intensive and expensive.

Moreover, accurate positioning of wireline tools is known to be difficult in high inclination applications (i.e., near horizontal wells). In high inclination sidetracking operations, some drilling operators elect to forego location of the casing joints at the considerable risk of milling through such joints. In such an approach a drill string including a milling assembly and a packstock (a whipstock including a packer assembly) is deployed in the wellbore. The packstock is typically positioned based upon measured depth and a casing string log. Unfortunately, due at least in part to the bending of the drill string in deviated wells, this approach is often characterized by a low degree of positional accuracy, which sometimes results in the well being sidetracked at a casing joint (or a failure in the sidetracking operation due to the above described difficulties in sidetracking at a casing joint).

Figure 5:
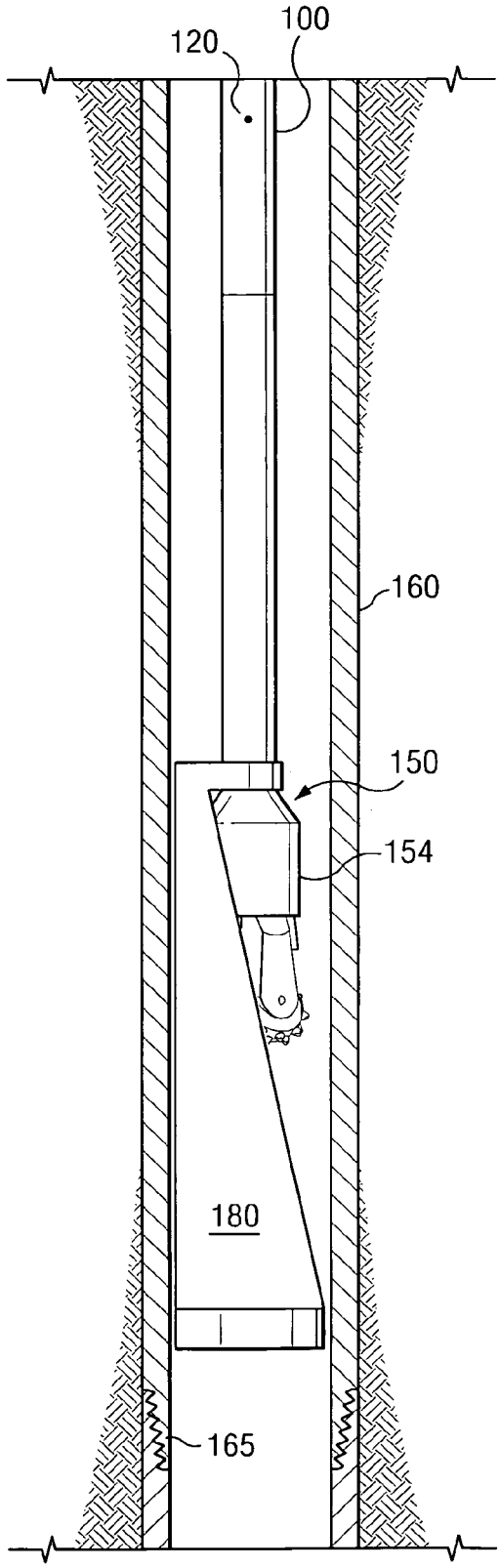
FIG. 5 depicts an arrangement according to this invention suitable for sidetracking a cased wellbore.

Referring now to FIG. 5, exemplary embodiments of this invention may be utilized to sidetrack a cased well without requiring a separate wireline run into the well to determine the location of the casing joints. Moreover, such embodiments advantageously enable the casing joints to be accurately located and the well to be sidetracked at a blank portion of the casing between adjacent casing joints, thereby substantially eliminating the risk of milling through a casing joint. A drill string including a BHA 150, having a drill bit assembly 154, and a downhole tool 100, having a sensor 120 (e.g., as described above with respect to FIG. 1), is deployed in a cased borehole 160. The drill string also includes a conventional pack stock 180 deployed about the BHA 150.

With continued reference to FIG. 5, one or more casing joints may be located as described above with respect to FIGS. 2 through 4. The packstock may then be positioned between the casing joints (e.g., a few feet uphole of a casing joint) and oriented at a predetermined tool face, for example, based on known techniques using conventional accelerometer and/or gyroscope measurements. Upon setting the packstock, a casing window may be milled in the casing and the sidetracked well drilled via known techniques.

Although the present invention and its advantages have been described in detail, it should be understood that various changes, substitutions and alternations can be made herein without departing from the spirit and scope of the invention as defined by the appended claims.

I claim:

1. A method for locating at least one casing joint in a cased wellbore, the cased wellbore including a substantially permanent magnetization, the method comprising:

(a) deploying a magnetic field measurement device in the cased wellbore, the magnetic field measurement device coupled to a drill string and positioned to be within sensory range of magnetic flux from the substantially permanent magnetization;

(b) measuring the magnetic flux along a length of the cased wellbore using the magnetic field measurement device; and (c) evaluating a change in the magnetic flux measured in (b) along the length of the cased wellbore to locate the at least one casing joint.

2. The method of claim 1, wherein the substantially permanent magnetization is imparted during a magnetic particle inspection procedure.

3. The method of claim 1, wherein the magnetic field measurement device comprises a tri-axial magnetometer, one axis of which is aligned with a longitudinal axis of the drill string.

4. The method of claim 1, wherein the magnetic field measurement device comprises a measurement while drilling sensor.

5. The method of claim 1, wherein the magnetic field measurement device has a saturation threshold of less than about 1.0 Gauss.

6. The method of claim 1, wherein the magnetic flux measured in (b) saturates the magnetic field measurement device.

7. The method of claim 1, wherein (b) comprises measuring a component of the magnetic flux that is substantially parallel with the longitudinal axis of the drill string.

8. The method of claim 1, wherein (b) comprises measuring at least one component of the magnetic flux that is substantially orthogonal to the longitudinal axis of the drill string.

9. The method of claim 1, wherein (c) comprises plotting the magnetic flux measurements acquired in (b) as a function of a measured depth of the cased wellbore.

10. The method of claim 1, wherein the change in the magnetic flux evaluated in (c) comprises a decrease in an axial component of the magnetic flux.

11. The method of claim 10, the change in the magnetic flux causes an axial sensor in the magnetic field measurement device to transition from a saturated state to an unsaturated state.

12. The method of claim 1, wherein the change in the magnetic flux evaluated in (c) comprises a change in sign of an axial component of the magnetic flux.

13. The method of claim 1, wherein the change in the magnetic flux evaluated in (c) comprises an increase in at least one cross-axial component of the magnetic flux.

14. The method of claim 13, wherein the change in the magnetic flux causes a cross-axial sensor in the magnetic field measurement device to transition from an unsaturated state to a saturated state.

15. The method of claim 13, wherein the change in the magnetic flux evaluated in (c) further comprises a dip or an inflection in the cross-axial component of the magnetic flux.

16. The method of claim 1, wherein:

(a) further comprises deploying the magnetic field measurement device at a plurality of discrete longitudinal positions in the cased wellbore; and (b) further comprises measuring the magnetic flux at each of the plurality of discrete positions.

17. The method of claim 16, further comprising:

(d) rotating the drill string at one of the discrete positions; and (e) acquiring another magnetic flux measurement after rotating the drill string in (d).

18. The method of claim 1, further comprising:

(d) comparing a longitudinal spacing between at least two casing joints with a known wellbore tubular length.

19. The method of claim 1, further comprising:

(d) milling an opening in the casing at a position selected to avoid milling through the located casing joint.

20. A method for detecting a casing joint between adjacent, magnetized tubulars in a cased wellbore, the method comprising:

(a) deploying a magnetic field measurement device at first and second positions in the cased wellbore, the magnetic field measurement device coupled to a drill string, the first and second positions selected to be within sensory range of magnetic flux from the cased wellbore;

(b) acquiring first and second magnetic field measurements at the corresponding first and second positions using the magnetic field measurement device;

(c) comparing the first and second magnetic field measurements acquired in (b) to determine whether either measurement was taken at a casing joint; and (d) repeating (a), (b), and (c) until at least one casing joint is located.

21. A method for sidetracking a cased wellbore, the cased wellbore including a substantially permanent magnetization, the method comprising:

(a) deploying a drill string in the cased wellbore, the drill string including a magnetic field measurement device and a drill bit assembly deployed thereon, the magnetic field measurement device positioned to be within sensory range of magnetic flux from the substantially permanent magnetization;

(b) measuring the magnetic flux along a length of the cased wellbore using the magnetic field measurement device to detect at least one casing joint; and (c) milling an opening in the cased wellbore using the drill bit assembly at a position selected to avoid milling through the located casing joint.

22. The method of claim 21, wherein the drill string further includes a packstock assembly deployed proximate to the drill bit assembly, the method further comprising:

(d) fixing the packstock in the cased wellbore at a location uphole of the detected casing joint prior to milling the opening in (c).

23. The method of claim 21, wherein the magnetic field measurement device comprises a tri-axial magnetometer, one axis of which is aligned with a longitudinal axis of the drill string.

24. The method of claim 21, wherein the magnetic field measurement device has a saturation threshold of less than about 1.0 Gauss.

25. The method of claim 21, wherein (b) further comprises evaluating a change in the magnetic flux along the length of the wellbore to detect the at least one casing joint.

26. The method of claim 25, wherein the change in the magnetic flux is selected from the group consisting of:

(1) a decrease in an axial component of the magnetic flux;

(2) a change in sign of an axial component of the magnetic flux; and (3) an increase in at least on cross-axial component of the magnetic flux.

* * * * *